US007044786B2

(12) United States Patent
Nimura

(10) Patent No.: US 7,044,786 B2
(45) Date of Patent: May 16, 2006

(54) CONNECTOR AND METHOD OF ASSEMBLING A CONNECTOR

(75) Inventor: Kazuhiko Nimura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/829,041

(22) Filed: Apr. 21, 2004

(65) Prior Publication Data

US 2004/0209488 A1 Oct. 21, 2004

(30) Foreign Application Priority Data

Apr. 21, 2003 (JP) ..... 2003-115953

(51) Int. Cl.
*H01R 13/40* (2006.01)

(52) U.S. Cl. ..... 439/587; 439/459; 439/582

(58) Field of Classification Search ..... 439/582, 439/38, 459, 466–467, 473, 587
See application file for complete search history.

(56) References Cited

U.S. PATENT DOCUMENTS 5,145,402 A * 9/1992 Plyler et al. ..... 439/459
5,741,147 A * 4/1998 Konoya et al. ..... 439/189
5,938,477 A * 8/1999 Yen ..... 439/622
6,302,734 B1 * 10/2001 Ichio et al. ..... 439/587
6,478,607 B1 * 11/2002 Tabata ..... 439/456
6,558,172 B1 * 5/2003 Kanagawa ..... 439/98

FOREIGN PATENT DOCUMENTS

JP 9-139249 5/1997

* cited by examiner

*Primary Examiner*—Michael C. Zarroli
(74) *Attorney, Agent, or Firm*—Gerald E. Hespos; Anthony J. Casella

(57) ABSTRACT

A connector has a terminal accommodating space (12) and a wire accommodating space (22). A terminal fitting (35) is accommodated in the terminal accommodating space (12) and a wire (30) is connected with the terminal fitting (35). The wire (35) is bent into the wire accommodating space (22) to form an L-shape. A bite-in portion (24) is formed on the inner surface of the wire accommodating space (22) for engaging the wire (30) on an inner side of the bend to plastically deform the wire (30). The engagement of the wire (30) by the bite-in portion (24) reduces the resilient restoring force of the wire (30). As a result, the resilient restoring force of the wire (30) is less likely to incline the terminal fitting (35) in the terminal accommodating space (12).

12 Claims, 9 Drawing Sheets

CONNECTOR AND METHOD OF ASSEMBLING A CONNECTOR

BACKGROUND OF THE INVENTION

1. Field of the Invention

The invention relates to a connector accommodating a wire connected with a terminal fitting in a bent state and to a method of assembling such a connector.

2. Description of the Related Art

Japanese Unexamined Patent Publication No. H09-139249 and FIG. 9 herein disclose a known connector accommodating a wire connected with a terminal fitting in a bent state. With reference to FIG. 9, this connector has a housing 101 that accommodates a terminal fitting 102. The housing 101 has a tubular holder 103 that extends substantially at a right angle from the rear end of the housing 101. A wire 104 is connected with the rear end of the terminal fitting 102 and is bent in an L-shape in the holder 103.

The connector of FIG. 9 is used to arrange the bent wire 104 in a narrow space. For example, the connector of FIG. 9 may be used to arrange a wire for a vehicle-mounted audio device. A bending curvature of a bent portion 105 of the wire 104 desirably is made longer to cope with the narrow space. However, the wire 104 exerts a resilient restoring force that increases as the bending curvature is increased. Thus, the posture of the terminal fitting 102 in the housing 101 is inclined by the resilient restoring force of this wire 104, and the inclined terminal fitting 102 presents a problem of increased frictional resistance during connection with a mating terminal (not shown).

Some wires 104 have a four-layered structure of an inner conductor 104*a*, a core 104*b*, an outer conductive shielding layer 104*c*, and a sheath 104*d*. A wire 104 with this construction has a high bending rigidity. Thus, frictional resistance between the terminal fitting 102 and the mating terminal is increased further because the resilient restoring force of the wire 104 is larger.

An external pushing or pulling force may act on the wire 104 drawn out of the connector in a longitudinal direction (vertical direction in FIG. 9). Thus, the wire 104 is displaced in the longitudinal direction in the holder 103. The external force on the wire 104 in longitudinal direction acts also inclines the posture of the terminal fitting 102 about the bent portion 105.

The invention was developed in view of the above problem and an object is to suppress or prevent the terminal fitting from being inclined.

SUMMARY OF THE INVENTION

The invention relates to a connector with at least one terminal accommodating space for accommodating at least one terminal fitting. The connector also has a wire accommodating space that communicates with the rear end of the terminal accommodating space. The wire accommodating space is adapted to accommodate a wire connected with the rear end of the terminal fitting and bent at an angle, preferably substantially into an L-shape. A bite-in portion is formed on the inner surface of the wire accommodating space for plastically deforming the wire by biting into a bent portion of the wire.

The bite-in portion plastically deforms the bent portion of the wire. Thus, a resilient restoring force of the wire is reduced or lost. Accordingly, the resilient restoring force of the wire cannot significantly incline the terminal fitting in the terminal accommodating space and the overall operability of the connector is improved. The plastic deformation caused by the bite-in portion may affect only some of the elements of the wire (e.g. only the insulating resin that covers a conductor) and/or at some portions of the bent portion of the wire, such as the inner and/or outer part as seen with respect to the bending thereof.

The bite-in portion preferably bites in the bent portion of the wire at an inner side with respect to bending.

The terminal accommodating space preferably accommodates the terminal fitting with the longitudinal axis of the terminal fitting substantially aligned with forward and backward directions.

If the section of the wire from the biting position of the bite-in portion to the connected position with the terminal fitting is curved, the posture of the terminal fitting may be inclined due to a resilient restoring force created by the curved section of the wire. Thus, a section of the wire from a biting position of the bite-in portion to a connected position with the terminal fitting is substantially straight and the posture of the wire is not inclined.

An outer layer of the wire is at least partly removed at the bent portion of the wire to lower the diameter thereof.

The wire preferably has an inner conductor covered by a core made of an insulating material, such as resin. An outer conductor made of a tubular braided wire may be fit around the outer circumferential surface of the core. A sheath made of an insulating material, such as resin, may cover the outer conductor. The sheath may be stripped at the bend to expose at least part of the outer conductor.

The sheath has a resilient restoring force and contributes to the bending rigidity of the entire wire. However, the sheath is stripped from at least part of the bend where a resilient restoring force is to be created. Thus, the resilient restoring force of the wire is reduced and the inclination of the terminal fitting can be suppressed or prevented. Since the outer conductor is present at the bent portion, the function of the outer conductor is not lost.

A sheath contact surface preferably is formed on the inner surface of the wire accommodating space for contacting the outer circumferential surface of the sheath. The bite-in portion projects from the sheath contact surface by the thickness of the sheath. The outer diameter of the wire is smaller at the portion that has the sheath stripped than at portions covered by the sheath. The sheath-stripped portion of the wire may be arranged to be oblique to the sheath-covered portion if the inner surface of the wire accommodating space is substantially flat. However, the bite-in portion preferably projects from the sheath contact portion by the thickness of the sheath. Thus, the sheath-stripped portion of the wire from the leading end of the sheath to the biting position of the bite-in portion can be arranged to be coaxial with the sheath-covered covered portion of the wire.

The invention also relates to a connector with at least one terminal accommodating space for accommodating at least one terminal fitting. The connector also has a wire accommodating space that communicates with the rear end of the terminal accommodating space. The wire accommodating space is adapted to accommodate a wire connected with the rear end of the terminal fitting and bent at an angle, preferably substantially into an L-shape. At least one locking section may formed on the inner surface of the wire accommodating space for engaging a portion of the wire extending from the bent portion toward a side opposite from the terminal fitting to substantially prevent longitudinal displacements of the wire. Accordingly, even if an external force acts on the wire along its longitudinal direction, the inclination of the terminal fitting resulting from longitudinal displacement of the wire can be prevented.

The wire used with the above-described connector that has the locking section may have the above-described construction with an inner conductor covered by a core made of an insulating material, such as resin. An outer conductor made of a tubular braided wire may be fit around the outer circumferential surface of the core. A sheath made of an insulating material, such as resin, may cover the outer conductor. The sheath may be stripped to expose an end surface substantially normal to the longitudinal direction of the sheath, and the locking section may be engaged with the exposed end surface.

The invention also relates to a method of assembling a connector, such as one of the above-described connectors. The method comprises accommodating at least one terminal fitting in a terminal accommodating space of the connector. The method also comprises accommodating a wire connected with the terminal fitting in a wire accommodating space that communicates with the terminal accommodating space and bending the wire at an angle, preferably into a substantially L-shape. The method also includes urging a bent portion of the wire into a bite-in portion on the inner surface of the wire accommodating space for plastically deforming part of the wire.

The wire may be urged into the bite-in portion for biting into the bent portion of the wire at a position on an inner side with respect to the bend.

The method preferably comprises removing an outer layer of the wire at the bend for lowering the diameter of the wire.

An alternate method comprises accommodating at least one terminal fitting in a terminal accommodating space of a connector. The alternate method further comprises accommodating a wire connected with the rear end of the terminal fitting in a wire accommodating space that communicates with the terminal accommodating space while bending the wire at an angle, and preferably into a substantially L-shape. The alternate method then comprises engaging at least one locking section formed on the inner surface of the wire accommodating space with a portion of the wire extending from the bent portion toward a side opposite from the terminal fitting to substantially prevent longitudinal displacements of the wire.

The wire may have a sheath and the method may include stripping part of the sheath to expose an end surface substantially normal to the longitudinal direction of the sheath. The engagement step may include engaging the locking section with the exposed end surface.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
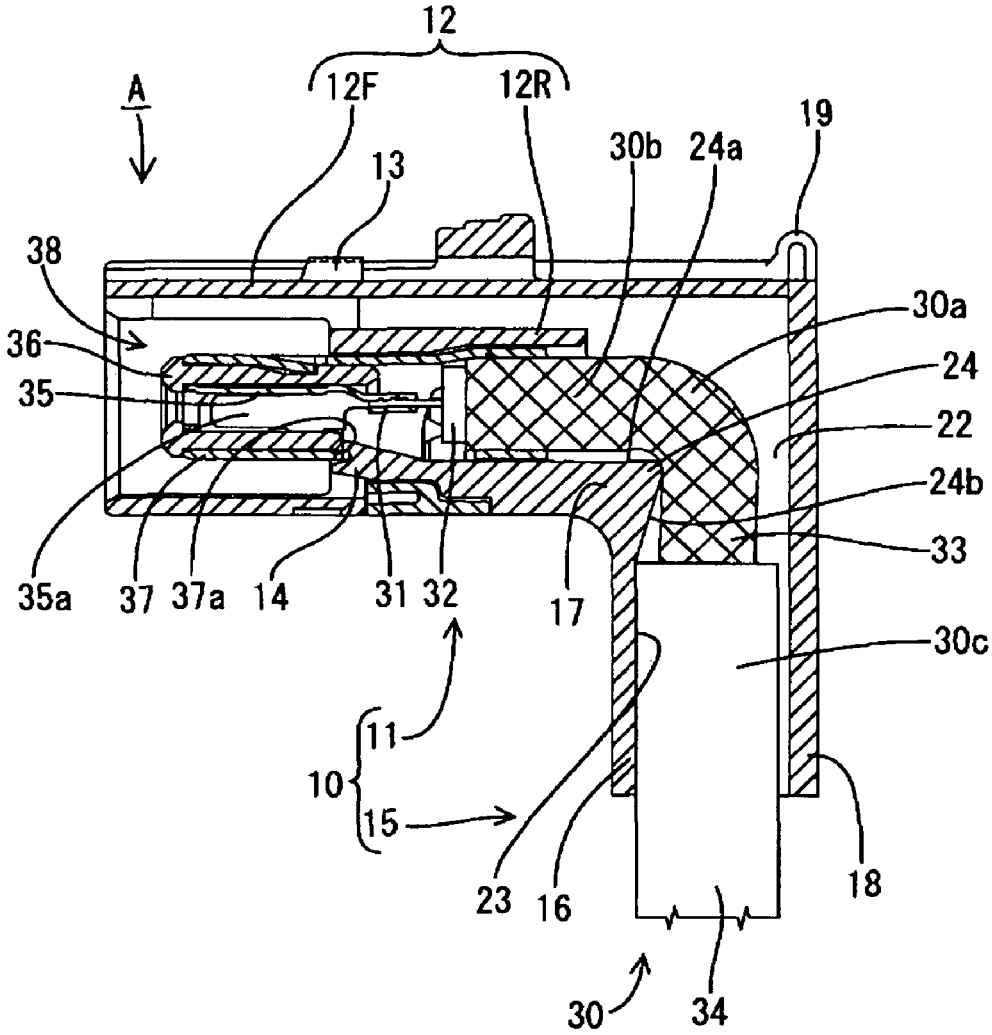
FIG. 1 is a section of a connector according to a first embodiment of the invention.
Figure 2:
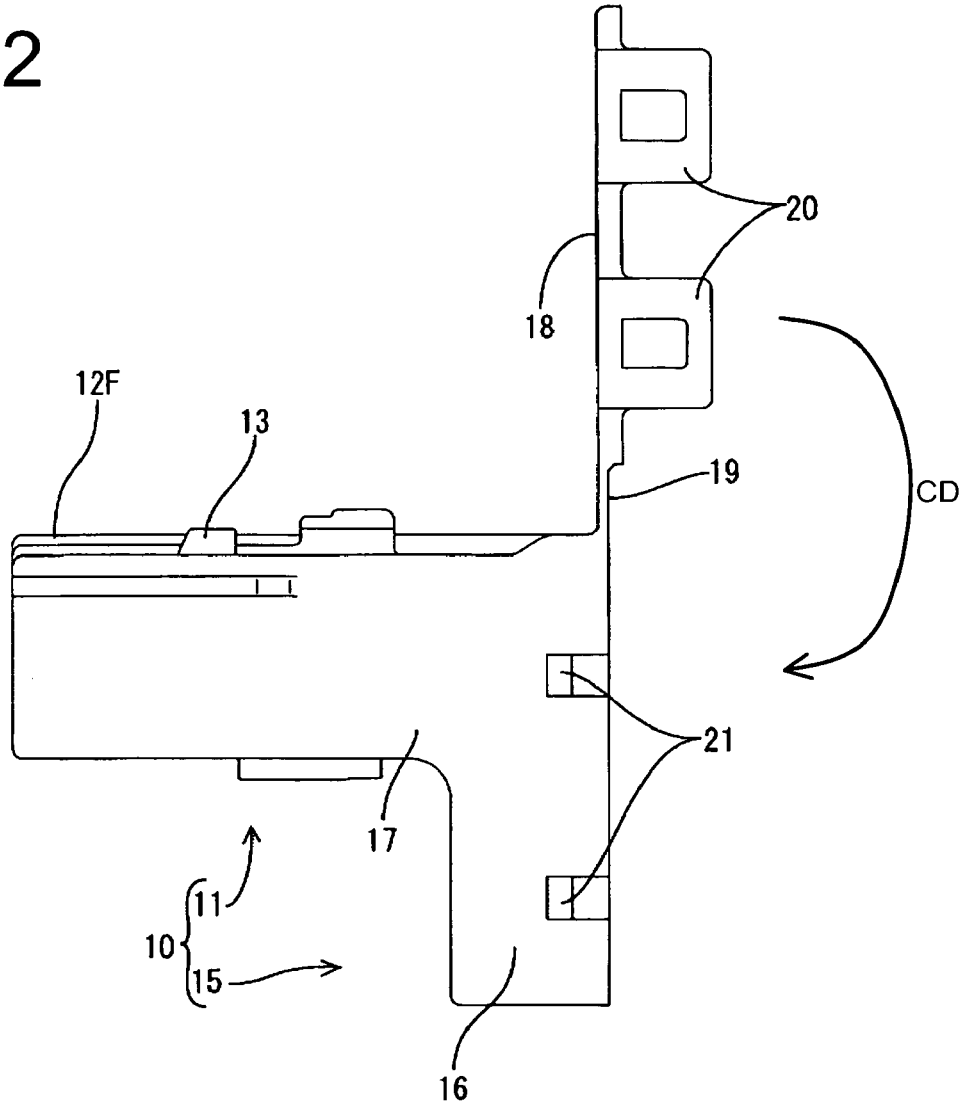
FIG. 2 is a side view showing the connector before a cover is united.
Figure 3:
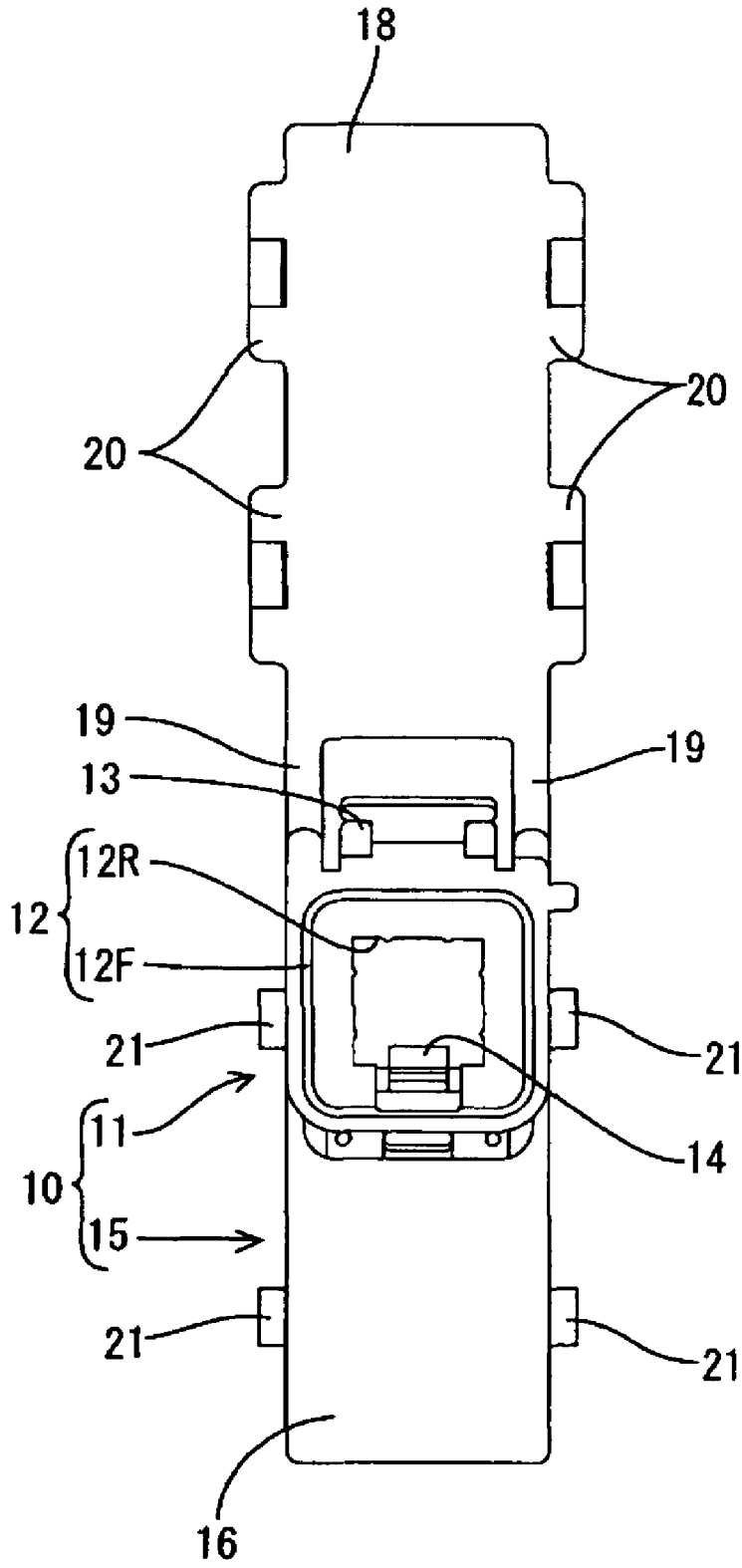
FIG. 3 is a front view of the connector before the cover is united.
Figure 4:
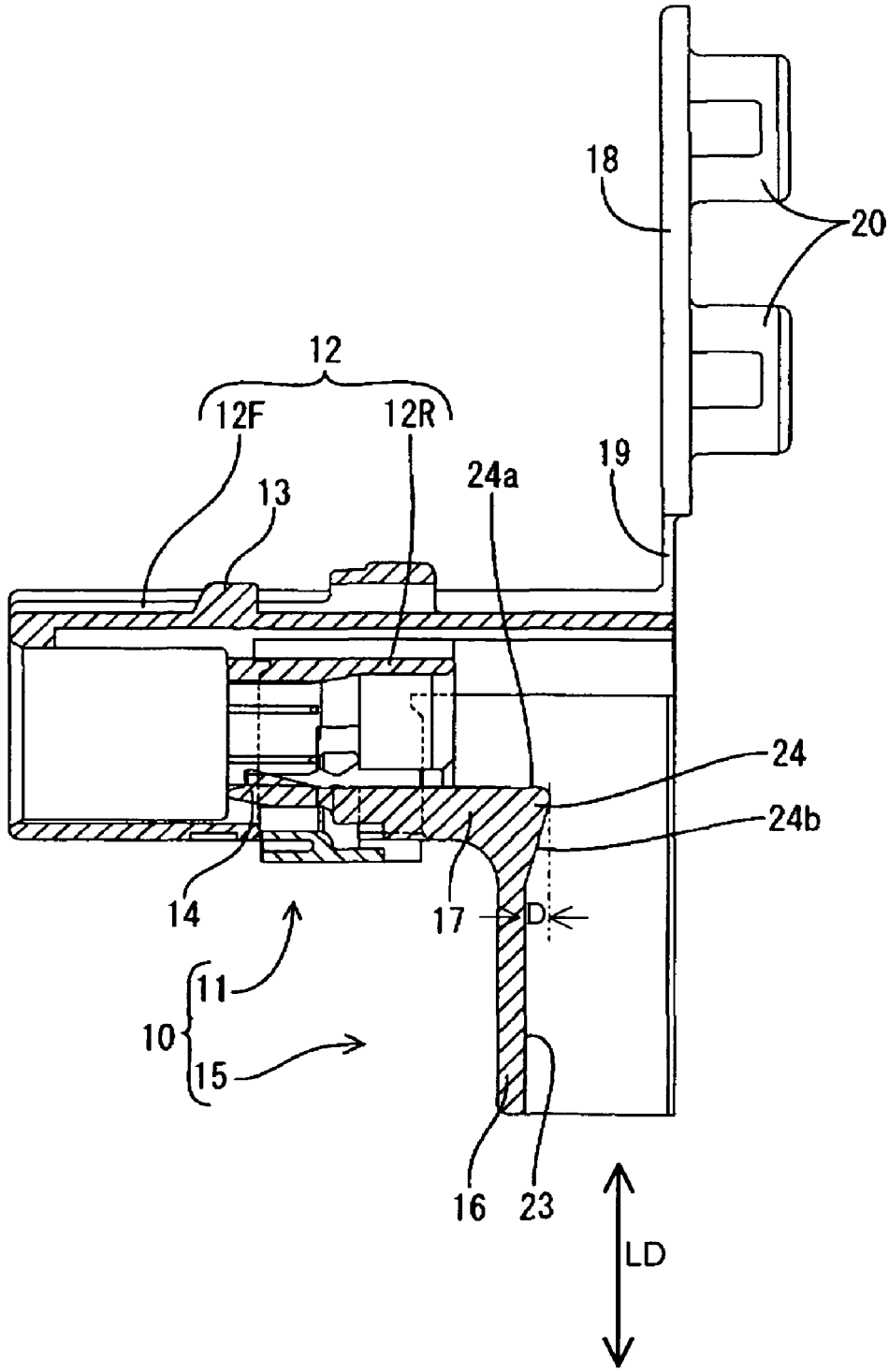
FIG. 4 is a section of the connector before the cover is united.

A connector according to a first embodiment of the invention is identified by the letter A in FIGS. 1 to 7. The left side of the connector A in FIG. 1 is configured for mating with a mating connector C, and is referred to herein as the front.

The connector A has a main body 10 that is a single integral part made e.g. of a synthetic resin. At least one terminal fitting 35 is accommodated in the main body 10 and a wire 30 is connected with the terminal fitting 35. A portion of the wire 30 in the main body 10 is bent at an angle, and preferably substantially normal into an L-shape.

The main body 10 is formed unitarily with a housing 11 and a holder 15 arranged substantially in an L-shape when viewed sideways.

The housing 11 preferably is substantially in the form of a rectangular tube that is hollow in forward and backward directions, and a terminal accommodating space 12 is defined inside the housing 11 for accommodating the terminal fitting 35. A rectangular tubular receptacle 12F is formed at a front half of the terminal accommodating space 12. A circuit board connector C is fittable into the receptacle 12F, and a lock projection 13 is formed on the ceiling surface of the receptacle 12F for engagement with a lock arm Ca of the circuit board connector C. A terminal holding portion 12R is formed at rear half of the terminal accommodating space 12. The terminal holding portion 12R has a substantially rectangular shape similar to, but is smaller than the receptacle 12F. A lock 14 is cantilevered forward and inward from the bottom surface of the terminal holding portion 12R and is configured for locking the terminal fitting 35. The terminal holding portion 12R has a stopper (not shown) for stopping the terminal fitting 35 against further forward movement.

The holder 15 is a vertically long rectangular tube with a main portion 16 and a cover 18 that is hinged to the main portion 16 for closing the upper end of the housing 11. The upper end of the holder 15 communicates with the rear end of the housing 11.

The main portion 16 is a substantially rectangular box whose rear and bottom surfaces are substantially entirely open. A rectangular tubular communicating portion 17 extends forward by a short distance at the upper end of the main body 16. The communicating portion 17 communicates with the terminal accommodating space 12 at the rear end of the housing 11. The bottom wall of the communicating portion 17 is thicker than other walls forming the main portion 16.

The cover 18 is a vertically long flat plate that substantially corresponds to the opening in the rear surface of the main portion 16. Left and right hinges 19 couple a base edge of the cover 18 to the upper edge of the opening in the rear surface of the main portion 16. The cover 18 stands up substantially at a right angle to the upper plate of the main portion 16 as shown in FIGS. 2 to 6 immediately after being molded. However, the cover 18 can be turned down in closing direction CD about the hinges 19 to be united with the main portion 16, and to close the open rear surface of the main portion 16. Left and right resilient locks 20 project from opposite left and right edges of the cover 18 and engage respective locking projections 21 on the left and right side plates of the cover 18 to lock the cover 18 in its mounted state. A wire accommodating space 22 is defined inside the holder 15 and communicates with the terminal accommodating space 12 when the cover 18 is mounted. The wire accommodating space 22 is exposed to the outside through the open bottom surface of the holder 15. The wire 30 that extends from the rear end of the terminal fitting 35 is accommodated in the wire accommodating space 22 while being bent substantially normal into an L-shape. Thus, the end of the wire 30 connected with the terminal fitting 35 is substantially normal to a portion of the wire 30 at a distance from the distal end.

The wire 30 has an inner conductor 31. A substantially cylindrical core 32 covers the inner conductor 31 and is made e.g. of an insulating synthetic resin. An outer conductor 33 covers the core and is formed by braiding metallic strands. A substantially cylindrical sheath 34 covers the outer conductor 33 and is made e.g. of an insulating synthetic resin. The sheath 34 is stripped at an end of the wire 30 to expose the outer conductor 33 by a specified length. Further, the core 32 projects from the end of the outer conductor 33 by a short distance, and the inner conductor 31 is exposed from the leading end of the core 32.

The terminal fitting 35 is long and narrow in forward and backward directions and has left and right resilient contact pieces 35*a* that are cantilevered forward. The exposed inner conductor 31 is connected with the rear end of the terminal fitting 35 by crimping, bending or folding. A substantially tubular element 36 made e.g. of an insulating synthetic resin surrounds the terminal fitting 36. The tubular element 36 and the terminal fitting 35 preferably are formed integrally by insert-molding. A conductive metallic shell 37 is mounted on the outer circumferential surface of the tubular element 36, and a rear end of the conductive metallic shell 37 is crimped, bent or folded into connection with the end of the outer conductor 33.

The terminal fitting 35, the tubular element 36 and the shell 37 form a connecting member 38. The wire 30 extends back from the rear end of the connecting member 38 in substantially coaxial alignment with the connecting member 38. The connecting member 38 is inserted into the main portion 16 from behind, and the lock 14 engages a locking hole 37*a* in the shell 37 to hold the connecting member 38 in the main portion 16. A substantially rear half of the held connecting member 38 is accommodated in the terminal holding portion 12R, whereas a substantially front half, thereof projects forward from the main portion 16 and into the receptacle 12F.

The wire 30 that extends from the rear end of the connecting member 38 is bent into an L-shape and is accommodated in the wire accommodating space 22 of the holder 15. The section of the wire 30 accommodated in the wire accommodating space 22 is comprised of a bent portion 30*a*, a substantially horizontal portion 30*b* that extends from the bent portion 30*a* to the connecting member 38 and a substantially vertical portion 30*c* that extends down from an end of the bent portion 30*a* opposite from the terminal fitting 35. The horizontal portion 30*b* and the bent portion 30*a* have the sheath 34 stripped to expose the outer conductor 34. The vertical portion 30*c* also has the sheath 34 stripped at its upper end to expose the outer conductor 33. The outer conductor 33 is covered substantially entirely by the sheath 34 at a part of the vertical portion 30*c* excluding the upper end. A dimension along forward and backward directions of the wire accommodating space 22 is equal to or slightly larger than the outer diameter of the sheath 34 except its upper end.

A sheath contact surface 23 is defined in an area of the inner surface of the front wall of the main portion 16, excluding its upper end, to prevent the front end of the terminal fitting 35 from being displaced up by a resilient restoring force of the wire 30 at the bent portion 30*a*. The sheath contact surface 23 is substantially flat and is aligned substantially parallel with the longitudinal direction of the vertical portion 30*c*. The outer surface of the sheath 34 of the vertical portion 30*c* contacts the sheath contact surface 23.

The bite-in portion 24 is at the upper end of the front wall of the main portion 16 and between the main portion 16 and the holder 15. The bite-in portion 24 projects back from the sheath contact surface 23 towards the longitudinal axis of the vertical portion 30*c*. A projecting distance D of the bite-in portion 24 from the sheath contact surface 23 substantially normal to the longitudinal direction LD of the main portion 16 is substantially equal to the thickness of the sheath 34. An upper surface 24*a* of the bite-in portion 24 is substantially flat and substantially flush with and continuous with the horizontal upper surface of the bottom wall. The second surface 24*b* of the bite-in portion 24 substantially faces the vertical portion 30*c* and overhangs obliquely towards a lower-back side. Thus, the second surface 24*b* is at an angle to the longitudinal direction LD of the main portion 16. Additionally, the upper surface 24*a* and the slanted rear surface 24*b* of the bite-in portion 24 form an acute angle. Accordingly, the bite-in portion 24 has a wedge shape when viewed sideways and juts obliquely towards the inner surface of the bent portion 30*a* of the wire 30 with respect to bending from a lower-front side as shown in FIG. 1.

Figure 5:
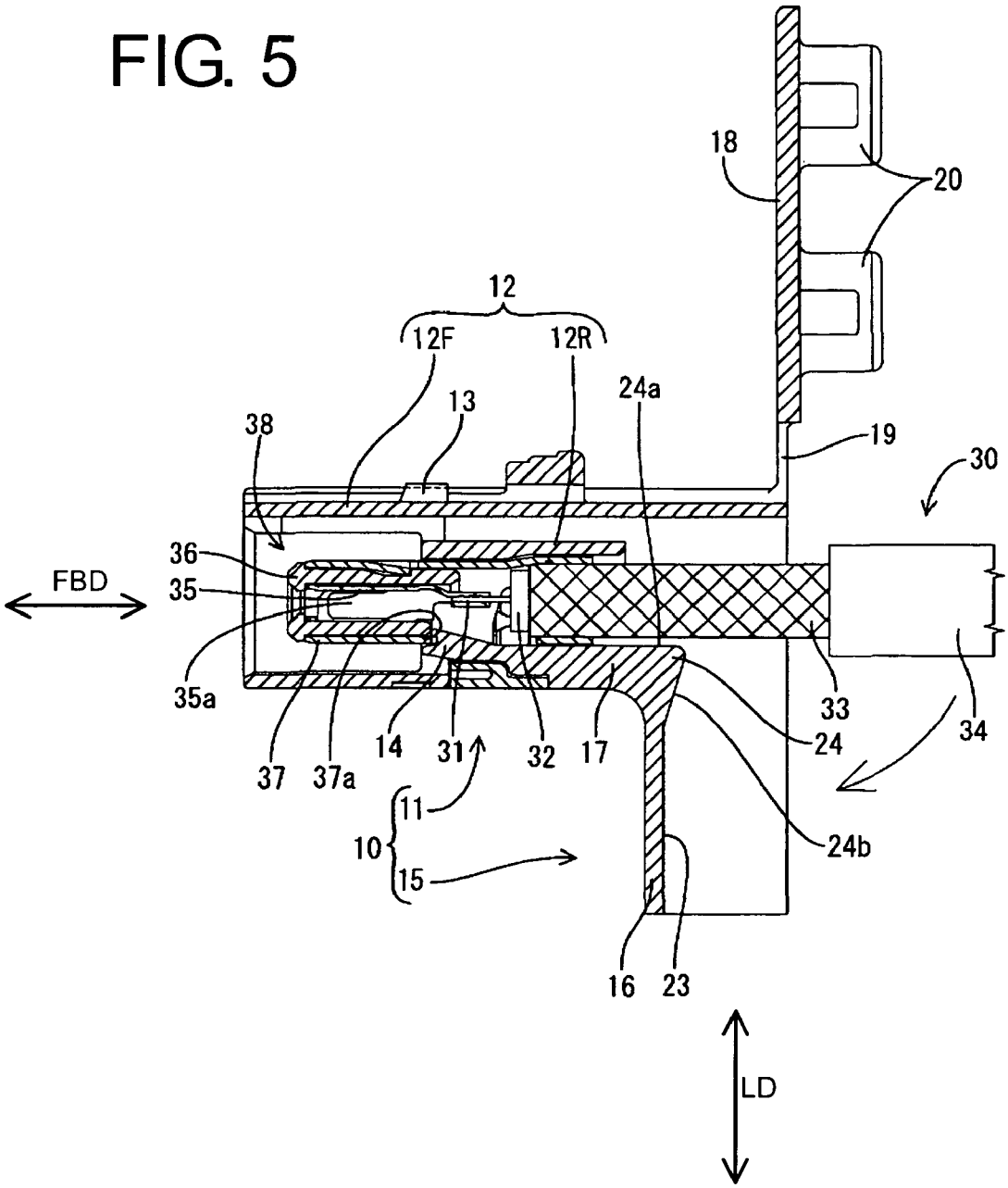
FIG. 5 is a section of the connector where a terminal fitting is accommodated.
Figure 6:
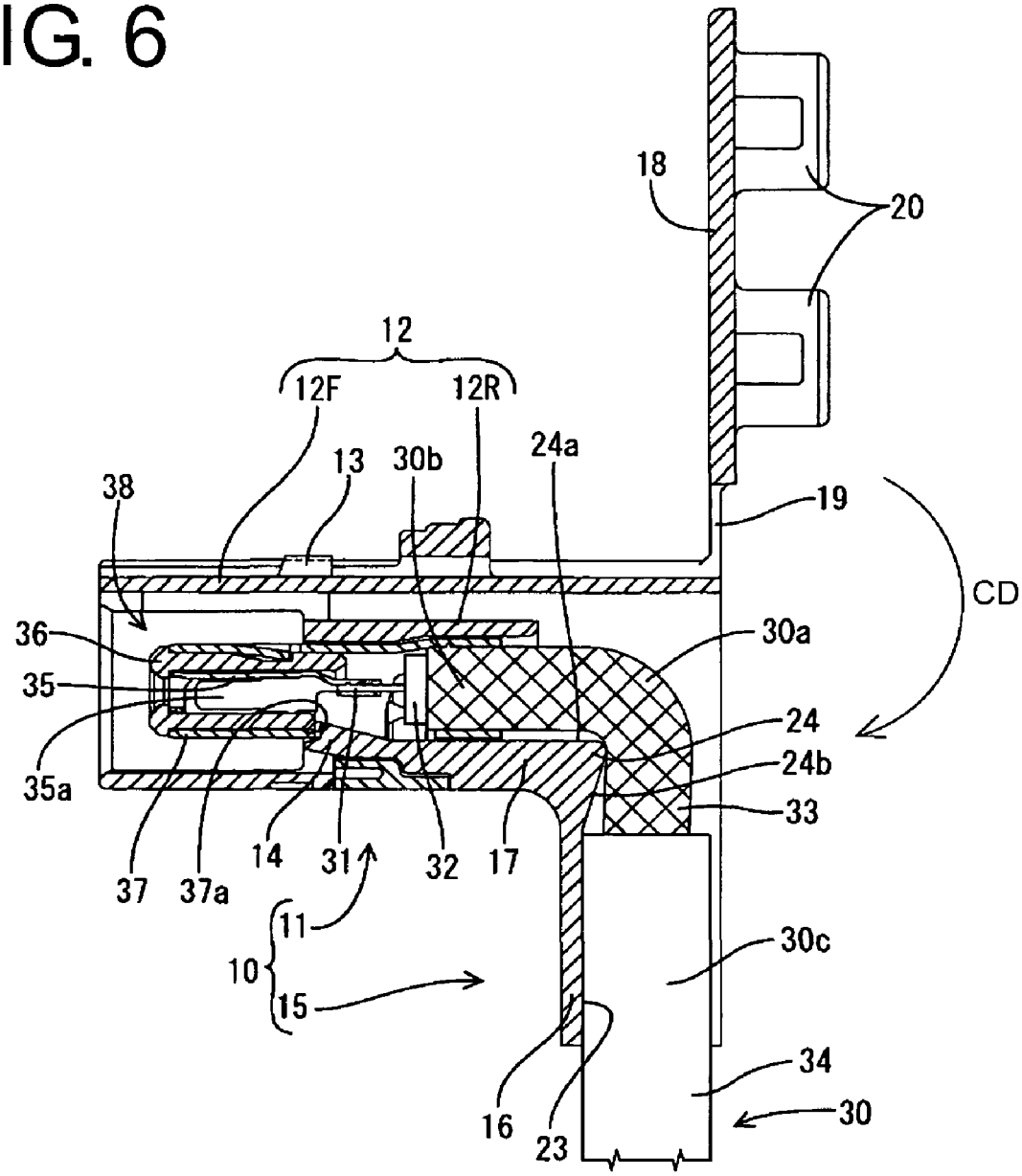
FIG. 6 is a section showing the connector where a wire is bent.

The connecting member 38 is connected initially with the end of the wire 30 and the resulting assembly is mounted into the terminal accommodating space 12 from behind, with the longitudinal direction of the connecting member 38 aligned with forward and backward directions FBD (see FIG. 5). In this state, the wire 30 extending from the rear end of the connecting member 38 is drawn back substantially along the forward and backward direction FBD to the outside from the main portion 16 in substantially the same direction as the longitudinal direction of the connecting member 38 (terminal fitting 35) through an upper-end space of the main portion 16 of the holder 15.

The drawn-out section of the wire 30 is accommodated in the main portion 16 (see FIG. 6) is bent down substantially at a right angle. At this time, the bent portion 30*a* of the wire 30 is pressed strongly against the projecting end of the wedge-shaped bite-in portion 24. The bite-in portion 24 thus bites into the bent portion 30*a* from the inner side, and at least a part of the wire 30 undergoes a plastic deformation.

The bent portion 30*a* is comprised of the inner conductor 31, the resin core 32 and the outer conductor 33. The inner conductor 31 and the outer conductor 33 are made of a soft metal having a relatively low rigidity and easily are deformed plastically. The resin core 32, however, undergoes a deformation beyond its resiliency limit (i.e. plastic deformation). A portion of the resin core 32 pressed by the bite-in portion 24 at the inner side with respect to bending is squashed, and a portion of the core 32 at the outer side with respect to bending is elongated to undergo a deformation beyond its resiliency limit (i.e. plastic deformation). Thus, the resilient restoring force of the bent portion 30*a* of the wire 30 is reduced or lost. Therefore, the bent portion 30*a* is kept bent in an L-shape even when the bending forces are removed from the wire 30.

The cover 18 is mounted to close the opening in the rear surface of the main portion 16 to complete the assembling of the connector (see FIG. 1). In this state, the horizontal portion 30*b* in the wire accommodating space 22 is held substantially straight and substantially parallel with the longitudinal direction of the terminal fitting 35. Both a part of the vertical portion 30*c* covered by the sheath 35 and a part thereof having the sheath 34 stripped to expose the outer conductor 33 are held substantially straight and substantially at a right angle to the horizontal portion 30*b*. Further, the upper end of the sheath 34 of the vertical portion 30*c* is at the same height as the bottom end of the slanted surface 24*b* of the bite-in portion 24.

Figure 7:
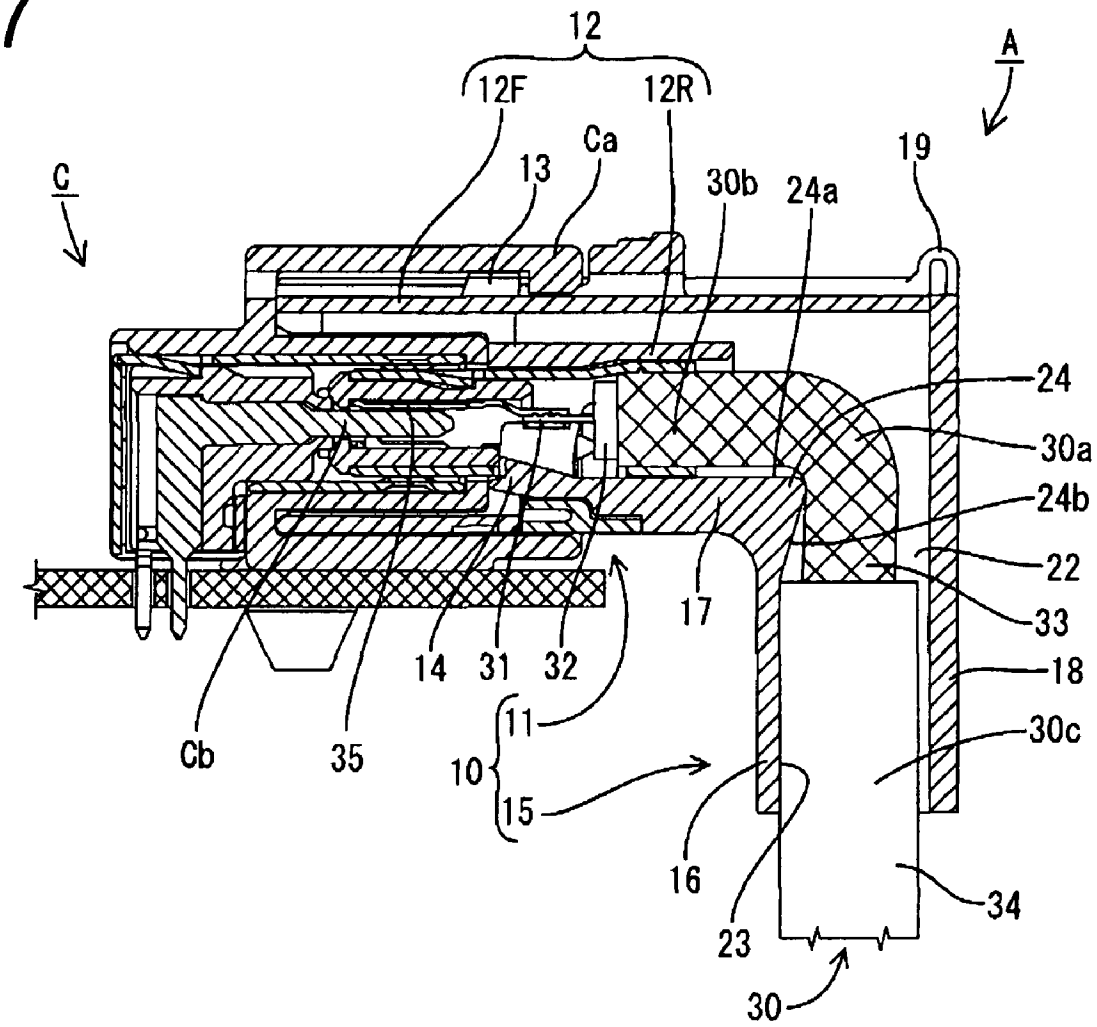
FIG. 7 is a section showing a connected state of the connector with a mating connector.

The connector A is connected to fit the receptacle 12F to the circuit board connector C (see FIG. 7). Upon connection, the lock arm Ca of the circuit board connector C engages the lock projection 13 of the receptacle 12F to hold the two connectors A, C connected with each other. In this connected state, a male tab Cb of the circuit board connector C is inserted into the connecting member 38 to be connected electrically with the terminal fitting 35.

As described above, the bent portion 30*a* of the wire 30 is deformed plastically by the bite-in portion 24 biting into the bent portion 30*a* at the inner side with respect to bending. Thus, the resilient restoring force of the wire 30 is reduced or lost. The biting position serves as a joint and a bending force on the horizontal and vertical portions 30*b*, 30*c* at the opposite sides of the bent portion 30*a* is hardly transmitted to the respective other portions 30*c*, 30*b*. Accordingly, inclination of the terminal fitting 35 in the terminal accommodating space 12 due to the resilient restoring force of the wire 30 is suppressed or prevented.

The plastic deformation by the bite-in portion 24 may occur only at some of the elements of the wire 30 (e.g. only the core 32 or only the sheath 34 if the bent portion 30*a* is surrounded by the sheath 34).

A section of the wire 30 from the biting position of the bite-in portion 24 to the connected position with the terminal fitting 35 (horizontal portion 30*b*) is curved. Thus, the posture of the terminal fitting 35 may incline due to a resilient restoring force caused by such a curved section. However, the horizontal portion 30*b* of the wire 30 is substantially straight. Thus, the posture of the terminal fitting 35 is not inclined.

The resin sheath 34 has a resilient restoring force and enhances the bending rigidity of the wire 30. However, the sheath 34 is stripped at the bent portion 30*a* where a resilient restoring force is created. Thus, the resilient restoring force of the wire 30 is reduced, and the inclination of the terminal fitting 35 is suppressed or prevented. Since the outer conductor 33 is present at the bent portion 30*a*, the function of the outer conductor 33 is not lost.

The outer diameter of the wire 30 is smaller at the portion that has the sheath 34 stripped than at the portion covered by the sheath 34. The sheath-stripped portion of the wire 30 would be oblique to the sheath-covered portion if the inner surface of the wire accommodating space 22 is substantially flat. However, the bite-in portion 24 projects from the sheath contact portion 23 by a distance D that is substantially equal to the thickness of the sheath 34. Thus, the sheath-stripped portion of the wire 30 from the leading end of the sheath 34 to the biting position by the bite-in portion 24 is substantially coaxial with the portion of the wire 30 covered by the sheath 34.

Figure 8:
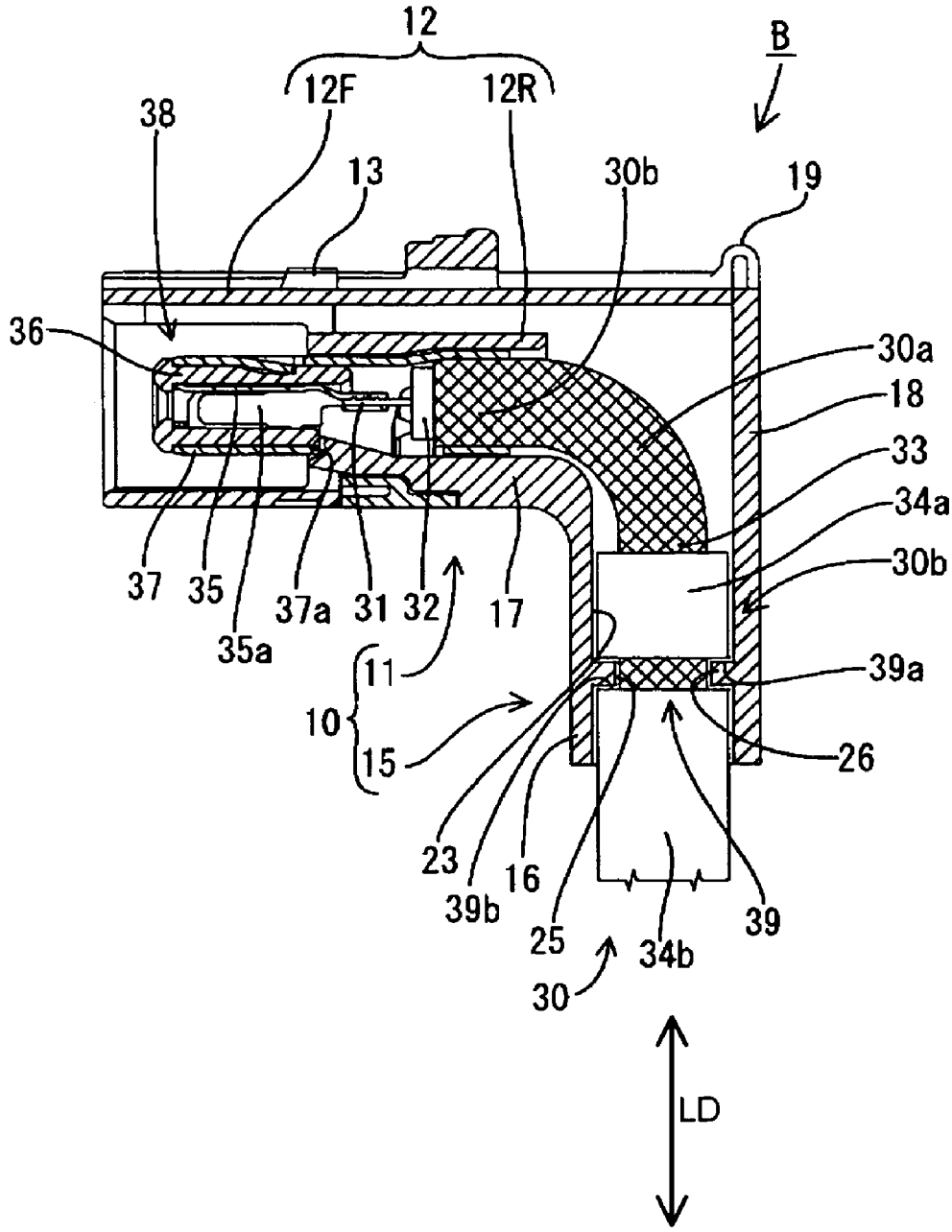
FIG. 8 is a section of a connector according to a second embodiment of the invention.
Figure 9:
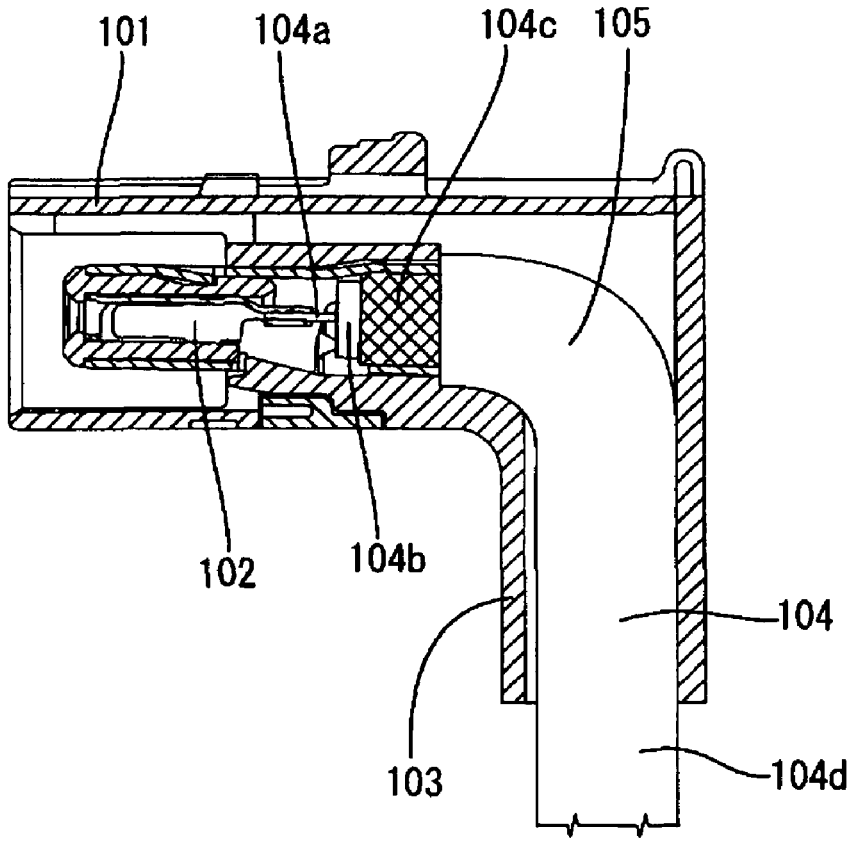
FIG. 9 PRIOR ART
FIG. 9 is a section of a prior art connector.

A second embodiment of the invention is described with reference to FIG. 8 and relates to connector B designed to prevent loose movements of the wire 30 along its longitudinal direction LD by providing locking sections 25, 26 instead of or additionally to providing the bite-in portion 24 described in the first embodiment. The other construction is similar to or the same as in the connector A of the first embodiment. No description is given on the structure, functions and effects of the similar elements, but they are identified by the same reference numerals.

A portion of the holder 15 forming the connector B for accommodating the vertical portion 30*b* of the wire 30 (i.e. a part of the accommodated section extending from the bent portion 30*a* toward a side opposite from the terminal fitting 35) is formed with the locking sections 25, 26 projecting in towards the wire from the inner surface of the main portion 16 and from the inner surface of the cover 18. The locking sections 25, 26 substantially surround the wire 30 over the entire circumference, and the inner circumferential surfaces thereof form a mating substantially circular shape substantially concentric with the vertical portion 30*c*. The inner diameter of this substantially circular shape is smaller than the outer diameter of the sheath 34 and larger than the outer diameter of the outer conductor 33.

On the other hand, the vertical portion 30*c* of the wire 30 has an engaging portion 39 formed by substantially continuously stripping the sheath 34 over substantially the entire circumference at a position slightly distanced from the upper end of the sheath 34. A part of the outer conductor 33 along the longitudinal direction LD is exposed annularly by partially stripping the sheath 34 and the sheath 34 is divided into an upper sheath 34*a* and a lower sheath 34*b* at this exposed part of the outer conductor 33. The bottom end surface of the upper sheath 34*a* and the upper end surface of the lower sheath 34*b* are engaging surfaces 39*a*, 39*b* vertically facing each other in the wire accommodating space 22.

The engaging surface 39*a* of the upper sheath 34*a* contacts the upper surfaces of the locking sections 25, 26 from above, and the engaging surface 39*b* of the lower sheath 34*b* contacts the lower surfaces of the locking sections 25, 26 from below. Thus, longitudinal movements of the third vertical portion 30*c* with respect to the holder 15 are prevented. Accordingly, a section of the wire 30 extending from the bent portion 30*a* towards the side opposite from the terminal fitting 35 is prevented from moving in the holder 15 even if a pushing or pulling force parallel with the longitudinal direction LD of the wire 30 acts on the wire 30 drawn out of the holder 15. Thus, a pushing or pulling force on the wire 30 is not transmitted to the terminal fitting 35 (connecting member 38). Therefore, the inclination of the terminal fitting 35 and forward and backward movements of the terminal fitting 35 in the housing 11 resulting from a longitudinal displacement of the wire 30 are prevented.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The housing formed with the terminal accommodating space and the holder formed with the wire accommodating space molded integrally into a single part in the foregoing embodiments. However, the invention is also applicable to a case where the housing and the holder are separate members. In such a case, the holder may be a single part or a part made of two pieces.

The wire is a coaxial cable having an outer conductor in the foregoing embodiments. However, the invention is not limited to coaxial cables and is also applicable to wires formed by covering one conductor by insulation.

The cover is turned in the same direction CD as the wire is bent to unite the cover with the main portion in the foregoing embodiments. However, the cover may be turned about an axis substantially parallel with the bent portion of the wire or in a direction substantially normal to the direction CD.

The cover is a single plate that can be opened and closed by being turned in the foregoing embodiments. However, the invention is also applicable to a cover is comprised of two plates which open on hinges.

The sheath is stripped at the bent portion of the wire in the foregoing embodiments, but it may be left at or near the bent portion if being thin or made of a soft material according to the invention.

Although the bite-in portion is in the form of a projection in the first embodiment, it may be, instead, merely a substantially right-angled corner according to the present invention.

A section of the wire from the biting position of the bite-in portion to the connected position with the terminal fitting is substantially straight in the first embodiment. However, this section may be curved.

The bite-in portion is a partly projecting projection in the first embodiment. However, an outer-conductor contact surface stepped from and continuous with the sheath contact surface may be formed on the inner surface of the wire accommodating space and the sheath-stripped portion may contact this outer-conductor contact surface according to the invention.

The sheath is partially stripped and the locking sections are engaged with a step formed by partially stripping in the second embodiment. However, wedge-shaped locks may bite in or engage or deform the outer circumferential surface (sheath) of the wire according to the invention.

A portion of the sheath to be engaged with the locking sections is stripped over the entire circumference in the second embodiment. However, this portion may be stripped only partly circumferentially.

Although the sheath is stripped to expose the outer conductor in the second embodiment, it may be so stripped to make a recess in the outer circumferential surface of the sheath without exposing the outer conductor.

The constructions for preventing loose movements of the wire by the locking sections described in the first and second embodiments may be combined.

The wire biting construction by the bite-in portion described in the first embodiment may be combined with the second embodiment.

What is claimed is:

1. A connector comprising:

a housing having opposite front and rear ends and at least one terminal accommodating space extending between the front and rear ends for accommodating at least one terminal fitting, a holder extending from the rear end of the housing, the holder having a wire accommodating space communicating with the terminal accommodating space and extending angularly from the terminal accommodating space, the wire accommodating space being configured to accommodate at least part of a wire connected with the terminal fitting so that the wire is bent substantially into an L-shape, and a bite-in portion formed integrally with the holder on an inner surface of the wire accommodating space, the bite-in portion projecting sufficiently into the wire accommodating space for plastically deforming at least part of the wire by biting in a bent portion of the wire, wherein the bite-in portion has a surface that extends substantially straight from a wall of the housing substantially adjacent a rear end of the terminal accommodating space.

2. A connector, comprising:

a wire having an outer layer that is at least partly removed adjacent and end of the wire to lower the diameter of the wire, the wire being bent where the outer layer has been removed to define a bent portion;

a terminal fitting secured to the end of the wire;

a housing having opposite front and rear ends and a terminal accommodating space extending between the ends for accommodating the terminal fitting;

a holder substantially at the rear end of the housing and defining a wire accommodating space communicating with terminal accommodating space, the wire accommodating space being aligned angularly of the terminal accommodating space and being configured to accommodate portions of the wire extending from the bent portion thereof; and a bite-in portion formed integrally with the holder on an inner surface of the wire accommodating space, the bite-in portion projecting sufficiently into the wire accommodating space for biting into the bent portion of the wire and plastically deforming at least part of the wire.

3. The connector of claim 2, wherein the wire has an inner conductor, a core made of an insulating material around the inner conductor, an outer conductor around the core, and a sheath made of an insulating material around the outer conductor, the sheath being the outer layer that is removed to at least partly expose the outer conductor.

4. The connector of claim 3, wherein a sheath contact surface is formed on the inner surface of the wire accommodating space for contacting an outer circumferential surface of the sheath, the bite-in portion projecting from the sheath contact surface by distance substantially equal to a radial thickness of the sheath.

5. A connector, comprising:

a housing having opposite front and rear ends and at least one terminal accommodating space for at least partly accommodating at least one terminal fitting, the terminal fitting being connected to a wire having an inner conductor, an insulating core around the inner conductor, an outer conductor around the insulating core, and an insulating sheath around the outer conductor, the sheath being partially stripped to expose an end surface substantially normal to a longitudinal direction of the sheath, a holder substantially at the rear end of the housing, the holder defining a wire accommodating space communicating with the terminal accommodating space and adapted to accommodate at least part of the wire connected with the terminal fitting so that the wire has a bent portion bent substantially into an L-shape, and a locking section formed integrally with the holder and projecting from an inner surface of the wire accommodating space at a location spaced from the housing, the locking section projecting sufficiently into the wire accommodating space for engaging the exposed end surface of the sheath of the wire extending from the bent portion towards a side opposite the terminal fitting for substantially preventing longitudinal displacement of the wire.

6. A connector for accommodating a wire and a terminal fitting, the wire having an end, portions of the wire spaced from the end having an insulating sheath thereon, the sheath defining a radial dimension, portions of the wire adjacent the end having the sheath removed, the terminal fitting being connected to the wire in proximity to the end and at locations spaced from the sheath, the connector comprising:

a terminal accommodating space having open front and rear ends and configured for accommodating the terminal fitting;

a wire accommodating space extending angularly from the rear end of the terminal accommodating space and having an open rear face, the wire accommodating space being configured to accommodate portions of the wire having the sheath thereon; and a projection projecting rearwardly into the wire accommodating space by a projecting distance substantially equal to the radial dimension of the sheath for engaging portions of the wire having the sheath removed.

7. The connector of claim 6, wherein the projection is formed on an internal corner between the terminal accommodating space and the wire accommodating space.

8. The connector of claim 6, wherein the projecting distance of the projection is sufficient to plastically deform portions of the wire having the sheath removed.

9. The connector of claim 6, further comprising a cover for selectively covering the open rear face of the wire accommodating space.

10. The connector of claim 8, wherein the cover is hinged to one of the terminal accommodating space and the wire accommodating space.

11. The connector of claim 9, further comprising a locking section formed on the cover and configured for engaging a portion of the wire having the sheath removed.

12. The connector of claim 10, wherein the projection and the locking section are disposed for engaging a cut end of the sheath.

* * * * *